United States Patent [19]

Wichman

[11] 4,373,214

[45] Feb. 15, 1983

[54] DISPOSABLE GARMENT WITH CARD POCKET

[75] Inventor: Cynthia A. Wichman, St. Charles, Ill.

[73] Assignee: The Kendall Company, Boston, Mass.

[21] Appl. No.: 371,026

[22] Filed: Apr. 22, 1982

[51] Int. Cl.[3] ..... A41B 13/10

[52] U.S. Cl. ..... 2/51; 2/DIG. 7

[58] Field of Search ..... 2/51, DIG. 7, 114

[56] References Cited

U.S. PATENT DOCUMENTS

| | | | |
|---|---|---|---|
| 3,359,569 | 12/1967 | Rotan et al. | 2/114 |
| 3,594,818 | 7/1971 | Planner | 2/114 |
| 3,648,290 | 3/1972 | Hartigan et al. | 2/114 |
| 3,721,999 | 3/1973 | Goya et al. | 2/114 |
| 3,754,284 | 8/1973 | Hartigan et al. | 2/114 |
| 3,803,640 | 4/1974 | Ericson | 2/114 |
| 3,864,757 | 2/1975 | Hartigan | 2/114 |
| 3,935,596 | 2/1976 | Allen, Jr. et al. | 2/114 |
| 3,977,025 | 8/1976 | Horan | 2/114 |
| 4,019,207 | 4/1977 | Newman et al. | 2/51 |
| 4,255,818 | 3/1981 | Crowley et al. | 2/51 |

*Primary Examiner*—Doris L. Troutman

*Attorney, Agent, or Firm*—Powell L. Sprunger

[57] ABSTRACT

A disposable garment comprising, a gown having a pair of sleeves, a front, a pair of side margins defining an open back for the gown, and a pocket having a pair of opposed closed sides, with one end of the pocket being closed, and the other end of the pocket being open. The garment has a first belt having one end secured to the gown and the other end being free, and a second belt having one end secured to the gown. The garment has a transfer card having one end received in the pocket through the open other pocket end, and the other end of the first belt is releasably attached to the card adjacent the other end of the card.

9 Claims, 6 Drawing Figures

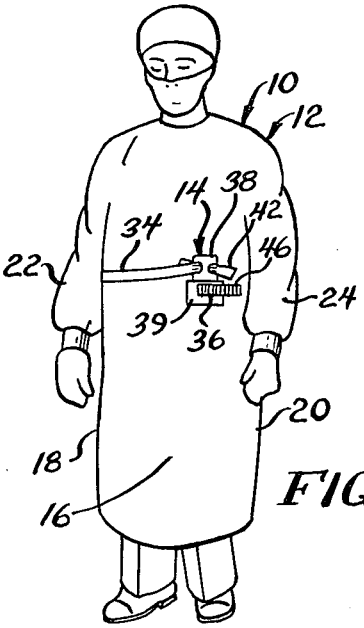
FIG. 1
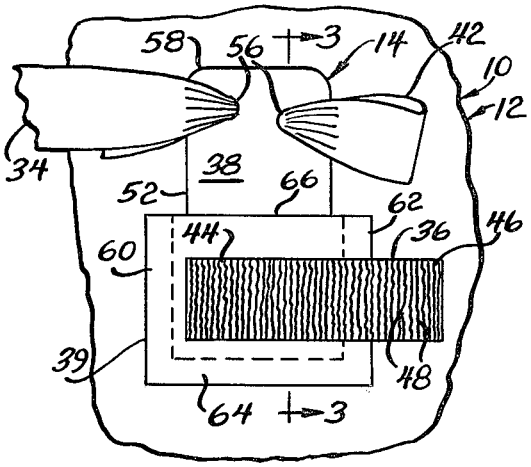
FIG. 2
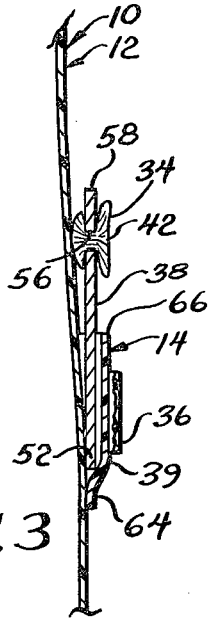
FIG. 3
FIG. 4
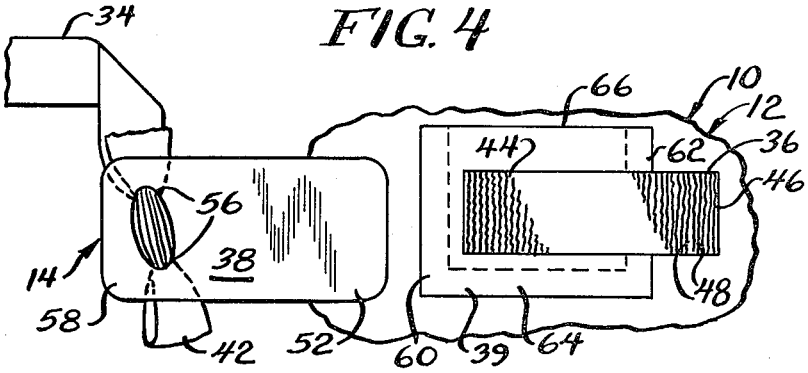
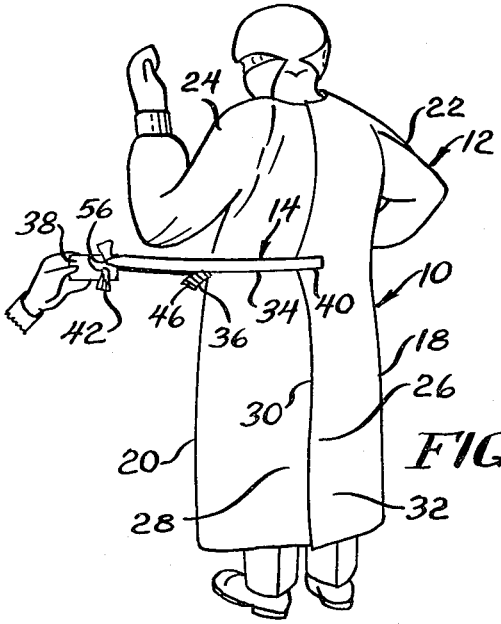
FIG. 5
FIG. 6
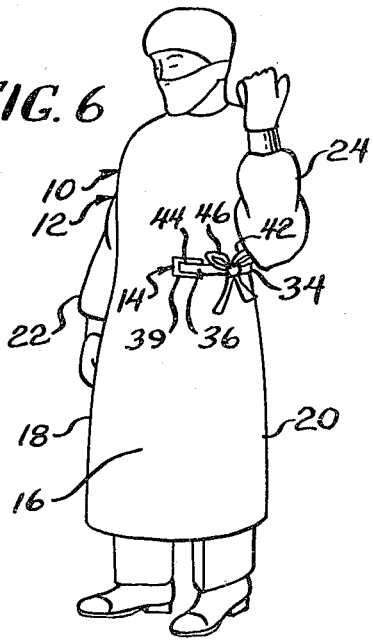

DISPOSABLE GARMENT WITH CARD POCKET

BACKGROUND OF THE INVENTION

The present application relates to disposable garments, and more particularly to surgical gowns.

Before the present invention, a various assortment of gowns have been proposed for the personnel in an operating room for use during a surgical procedure. Such gowns normally have a front, a pair of sleeves, and a pair of side margins defining an opening on the back of the gown. Such gowns also usually have a belting device in order to close the gown side margins on the back of the gown when the gown is being donned by the wearer. However, such belting devices have been unduly complex, or have increased the likelihood of contamination, such as when a belt end falls below the gown waist which is considered to be a contaminated region of the gown. Whenever a belt has touched a contamination area the belt is also considered to be contaminated, and the entire gown must be removed from the wearer and a new gown must be placed on the wearer, resulting in waste and inconvenience to the operating team.

SUMMARY OF THE INVENTION

A principal feature of the present invention is the provision of an improved disposable garment of simplified construction.

The garment of the present invention comprises, a gown having a pair of sleeves, a front, a pair of side margins defining an open back for the gown, and a pocket having a pair of opposed closed sides, with one end of the pocket being closed, and the other end of the pocket being open. The garment has a first belt having one end secured to the gown and the other end being free, and a second belt having one end secured to the gown. The garment has a transfer card having one end received in the pocket through the open other pocket end, and means for releasably attaching the other end of the first belt adjacent the other end of the card.

A feature of the present invention is that the card and other end of the first belt is securely retained in place on the gown by the pocket.

Thus, a feature of the present invention is that the card and first belt is prevented from falling below the waist of the gown which is considered a contaminated region of the gown.

Yet another feature of the invention is that the card may be readily removed from the pocket by the wearer.

Another feature of the invention is that the card may then be grasped by a nonsterile person, such as a circulating nurse, who may then pass the first belt and card around the back of the gown.

Still another feature of the invention is that the first belt may be grasped by the wearer, and the card may be readily removed from the first belt by the nonsterile person, after which the wearer may tie the other ends of the first and second belts together in order to secure the gown in place on the wearer.

Yet another feature of the invention is that the belting device for the gown is of simplified construction and reduced cost.

Another feature of the invention is that the belting device may be utilized in a simplified manner.

Further features will become more fully apparent in the following description of the embodiments of this invention and from the appended claims.

DESCRIPTION OF THE DRAWINGS

In the drawings:

FIG. 1 is a perspective view illustrating the garment of the present invention on a wearer with a belting device in place;

FIG. 2 is a fragmentary plan view on an enlarged scale of the belting device comprising a first belt, a second belt, a transfer card, and a pocket;

FIG. 3 is a fragmentary sectional view taken substantially as indicated along the line 3—3 of FIG. 2;

FIG. 4 is a fragmentary plan view illustrating the card as removed from the pocket;

FIG. 5 is a perspective view illustrating the first belt as passed around the back of the garment by use of the transfer card; and FIG. 6 is a perspective view illustrating the first and second belts secured together on a side of the garment.

DESCRIPTION OF THE PREFERRED EMBODIMENTS

Referring now to FIGS. 1–3, and 5, there is shown a disposable garment generally designated 10 comprising a surgical gown 12, and a belting device 14 on the gown 12. The gown 12 has a front 16, a pair of opposed sides 18 and 20, a pair of sleeves 22 and 24, and a pair of opposed side margins 26 and 28 defining an opening 30 on the back 32 of the gown 12. Once the gown 12 is placed on the wearer, as shown in FIG. 1, it is necessary to secure the side margins 26 and 28 together in an overlapping relationship in order to close the opening 30 on the back 32 of the gown 12. The gown 12 may be constructed of any suitable flexible material, such as a nonwoven material.

With reference to FIGS. 1–3, the belting device 14 comprises a first belt 34, a second belt 36, a transfer card 38, and a pocket 39 on the gown 12. The first belt 34 has one end 40 secured to the side margin 26 of the gown 12 adjacent the opening 30, by suitable means such as adhesive, and extends around the side 18 of the gown 12 toward the front 16 of the gown 12 where the other free end 42 of the first belt 34 is positioned on the front 16 of the gown 12. The first belt 34 may be constructed of any suitable flexible material, such as a nonwoven material. The second belt 36 has one end 44 secured to the front 16 of the gown 12, such as the pocket 39, by suitable means such as adhesive, and the other end 46 of the second belt 36 is free of attachment to the gown. The second belt 36 may be constructed of Tyvek, a trademark of du Pont, which designates a family of tough, durable sheet products made of high density polyethylene fibers by an integrated spinning and bonding process. The second belt 36 is micropleated or compacted, as disclosed in U.S. Pat. No. 3,754,284, incorporated herein by reference. In general, the second belt is micropleated with about 120 pleats 48 per inch. In use, the compacted or micropleated portion of the belt 36 may be extended to about 850 percent of its compacted length, with the unextended length of the second belt 36 being greatly reduced to a short configuration, such that the second belt 36 remains generally straight on the gown 12, and has insufficient length to contact the contaminated waist region of the gown 12 in the unextended configuration of the second belt 36.

The transfer card 38 may be made of relatively stiff material, such as cardboard, or a suitable plastic material. The card 38 may have a generally rectangular configuration, as shown, with one end 52 of the card 38 being received in the pocket 39. The card 38 also has a pair of aligned and spaced apertures 56 adjacent the other end 58 of the card 38. As shown, the other end 42 of the first belt 34 is threaded in a doubled configuration through the apertures 56 in order to releasably retain the other end 42 of the first belt 34 in place on the card 38.

The pocket 39 may comprise a generally rectangular sheet of flexible material, such as a suitable nonwoven material. The pocket has opposed sides 60 and 62 secured to the front 16 of the gown 12 by suitable means, such as by adhesive. The pocket 39 also has one end 64 secured to the gown 12 by suitable means, such as by adhesive, with the securing means at the one end 64 of the pocket 39 extending between the opposed sides 60 and 62. Thus, the other end 66 of the pocket 39 is open in an upward direction on the gown 12 in order to releasably receive the one end 52 of the card 38.

In use, the sterile wearer dons the gown 12, as shown in FIG. 1, after which the wearer grasps the card 38 adjacent the other end 58 of the card 38, and removes the card 38 from the pocket 39 by lifting the card 38 in an upward direction, as shown in FIG. 4. Next, the wearer passes the card 38 to a nonsterile person in the operating room, such as a circulating nurse, who grasps the one end 52 of the card 38 in order to prevent contamination to the other end 42 of the first belt 34. The nonsterile person then passes the card 38 and attached first belt 34 around the side 18 and back 32 of the gown 12, as shown in FIG. 5, to a location adjacent the side 20 of the gown 12. Next, the wearer grasps the first belt 34 and pulls the belt 34 while the nonsterile person holds the card 38 in order to release the other end 42 of the first belt 34 from the card 38. After the first belt 34 has been removed from the card 38, the wearer extends the micropleated second belt 36 to an enlarged configuration, and ties the free other ends 42 and 46, respectively, of the first and second belts 34 and 36 together on the side 20, as shown in FIG. 6. In this manner, the tied first and second belts 34 and 36 secure the gown side margins 26 and 28 together in an overlapping relationship in order to secure the back 32 of the gown 12 and close the opening 30.

Thus, in accordance with the present invention the belting device 14 initially retains the card 38 and the first belt 34 at a location on the front of the gown to prevent contamination to the belting device 14. Also, the belting device 14 may be utilized in a simplified manner to secure the gown about the wearer while minimizing the possibility of contamination to the belts 34 and 36 of the gown 12 during placement of the belting device 14. Also, the belting device 14 of the present invention is of simplified construction and reduced cost.

The foregoing detailed description is given for clearness of understanding only, and no unnecessary limitations should be understood therefrom, as modifications will be obvious to those skilled in the art.

I claim:

1. A disposable garment, comprising:

a gown having a pair of sleeves, a front, a pair of side margins defining an open back for the gown, and a pocket having a pair of opposed closed sides, with one end of the pocket being closed, and the other end of the pocket being open;

a first belt having one end secured to the gown and the other end being free;

a second belt having one end secured to the gown; and a transfer card having one end received in the pocket through the open other pocket end, and means for releasably attaching the other end of the first belt adjacent the other end of the card.

2. The garment of claim 1 wherein the pocket comprises a sheet of flexible material having opposed sides secured to the gown, and one end secured to the gown at a location extending between said sides.

3. The garment of claim 1 wherein the open end of the pocket faces upwardly on the gown.

4. The garment of claim 1 wherein the one end of the first belt is attached to one of said gown side margins.

5. The gown of claim 1 wherein the card and pocket are located over the front of the gown.

6. The gown of claim 1 wherein the second belt is micropleated.

7. The garment of claim 1 wherein the attaching means comprises a pair of spaced apertures in the card, and the other end of the first belt being threaded through said apertures.

8. The garment of claim 7 wherein the other end of the first belt is doubled in the region of the card.

9. The garment of claim 1 wherein the one end of the second belt is secured to the pocket.

* * * * *